United States Patent [19]

Busdeker

[11] Patent Number: 4,979,683

[45] Date of Patent: Dec. 25, 1990

[54] PORTABLE SMALL SCALE MEDICAL WASTE TREATMENT MACHINE

[76] Inventor: Allan J. Busdeker, 2909 M Cowley Way, San Diego, Calif. 92117

[21] Appl. No.: 404,875

[22] Filed: Sep. 8, 1989

[51] Int. Cl.[5] ..... B02C 25/00

[52] U.S. Cl. ..... 241/36; 241/37.5; 241/99; 241/101.2

[58] Field of Search ..... 241/36, 37.5, 99, DIG. 38, 241/101.2, 100, 282.1, 282.2

[56] References Cited

U.S. PATENT DOCUMENTS

| | | | |
|---|---|---|---|
| 3,926,379 | 12/1975 | Dryden et al. | 241/99 X |
| 4,269,364 | 5/1981 | Moriconi et al. | 241/99 X |
| 4,618,103 | 10/1986 | Wilson et al. | 241/99 X |
| 4,619,409 | 10/1986 | Harper et al. | 241/99 X |
| 4,860,958 | 8/1989 | Yerman | 241/99 X |
| 4,884,756 | 12/1989 | Pearson | 241/99 X |
| 4,905,916 | 3/1990 | Sorwick et al. | 241/99 X |

*Primary Examiner*—Mark Rosenbaum

[57] ABSTRACT

A machine for the treatment of infectious medical waste which eliminates sharps and the need for special waste handling and hauling.

The waste enters hopper (13) and is chopped in chamber (15). A high phenol coefficient liquid is stored in container (28) and pumped into the cutting chamer (15). The chopped treated waste travels down chute (18) and is compacted in container (20). Additionally, all functions are interlocked with sensors (FIGS. 4A–C) to insure no waste passes through the machine without being treated.

1 Claim, 6 Drawing Sheets

PORTABLE SMALL SCALE MEDICAL WASTE TREATMENT MACHINE

BACKGROUND—FIELD OF INVENTION

This invention relates to the treatment of infectious medical waste and renders the said waste noninfectious and safe for disposal without special handling.

BACKGROUND—DESCRIPTION OF PRIOR ART

Medical facilities traditionally have treated waste with autoclaving, high temperature burning, and burying without any pretreatment. I was able to find a machine that treats medical waste with a high phenol coefficient liquid on a very large scale only. The waste is intended to be shipped or hauled to a site and then treated. This way of handling can only cause more accidents simply because more individuals are coming in contact with the waste. My invention eliminates outside handling until after treatment. Also waste generation is in close proximity to the treatment machine so waste can be dealt with instantaneously. Even more critical is the fact that all functions of the machine are interlocked to insure treatment of all infectious waste passing through the machine and insure operator safety.

The most effective solution to handling infectious medical waste is for every generator of said waste to be responsible for his or her own waste. This machine can fulfill that responsibility. Currently no such machine is available.

OBJECTS AND ADVANTAGES

Accordingly, several objects and advantages are:

(a) to provide medical waste treatment machine for the small scale generator of medical waste;

(b) to provide a machine that disposes and treats "sharps" so they can be handled safely;

(c) to provide a machine that renders infectious medical waste safe to handle in a conventional manner;

(d) to provide a machine for physicians and dentists of small to moderate size a means of treating their own generated waste;

(e) to provide a machine that will help keep medical waste from spreading disease;

(f) to provide a machine that will help keep medical waste off our coast lines and provide a cleaner environment;

(g) to provide a machine that will compact waste for convenient handling;

(h) to provide a machine that will use a disposable container that is readily available and fits into the compacting area of the machine for easy disposal and cost savings;

(i) to provide a machine that uses bleach as the high phenol coefficient treatment substance. Bleach is easily biodegradable with ultraviolet light and oxygen. The breakdown by-products of bleach being essentially salt and chlorine. Both environmentally safe;

(j) to provide a machine to relieve the user of costly hauling expenses by special waste handlers;

(k) to provide a machine that will not operate because all functions of the machine are interlocked to insure no infectious waste passes through the machine without being properly treated;

(l) to provide a machine that can be used as a subsystem for close proximity and immediate treatment of sharps and associated medical waste;

(m) to provide a machine that will break-up needles, scalpel blades, cotton swabs, gauze, teeth, disposable plastic syringes, tongue depressors, and plastic gloves;

(n) to provide a machine that displays all interlocked machine parts with light emitting diodes to provide the operator with constant monitoring points and tell the operator if fluid levels are low, not flowing properly or the cutting blades are not spinning properly;

(o) to provide a machine with automatic and manual cycle times to provide the user with small or large waste loads to prevent phenol fluid waste.

DRAWING FIGURES

Figure 4A:
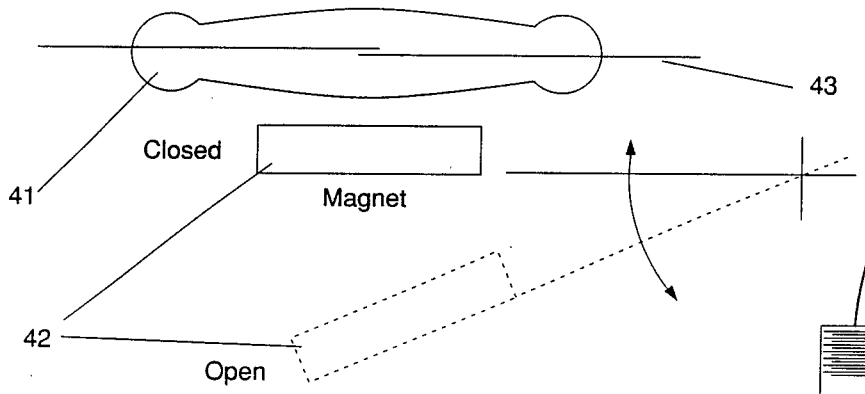
Figure 4B:
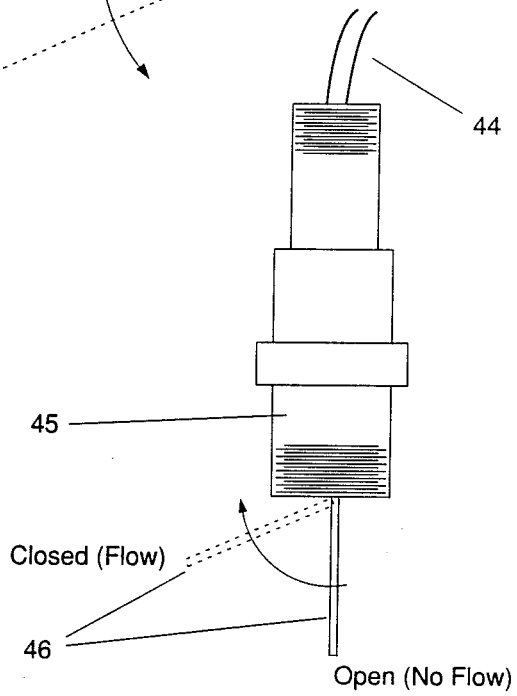
Figure 4C:
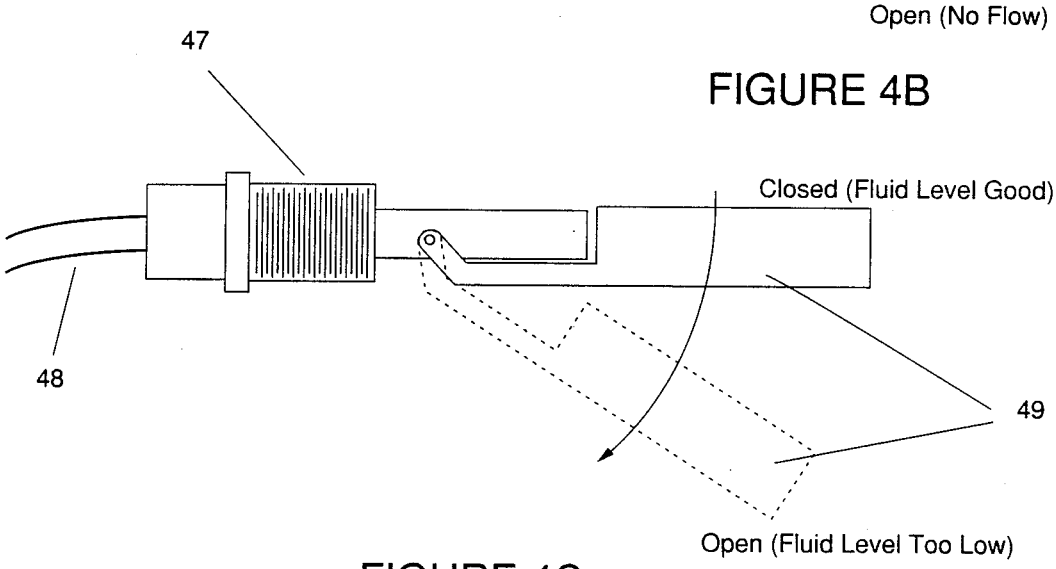

FIGS. 4A, 4B, and 4C show the interlock sensors used to monitor machine operation.

Figure 5:
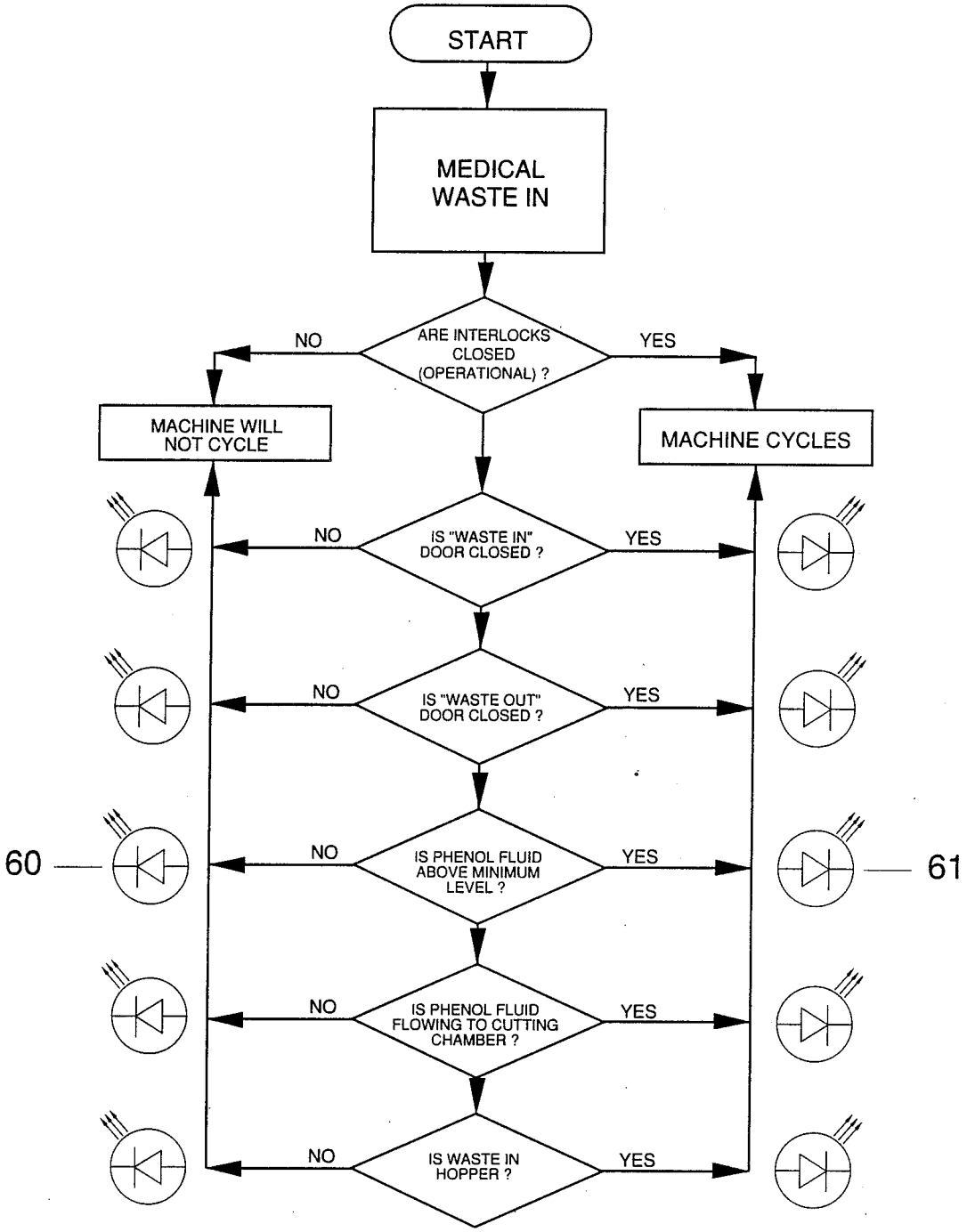

FIG. 5 is a flow chart interlock diagram showing all interlock locations on the medical waste treatment machine.

Figure 6A:
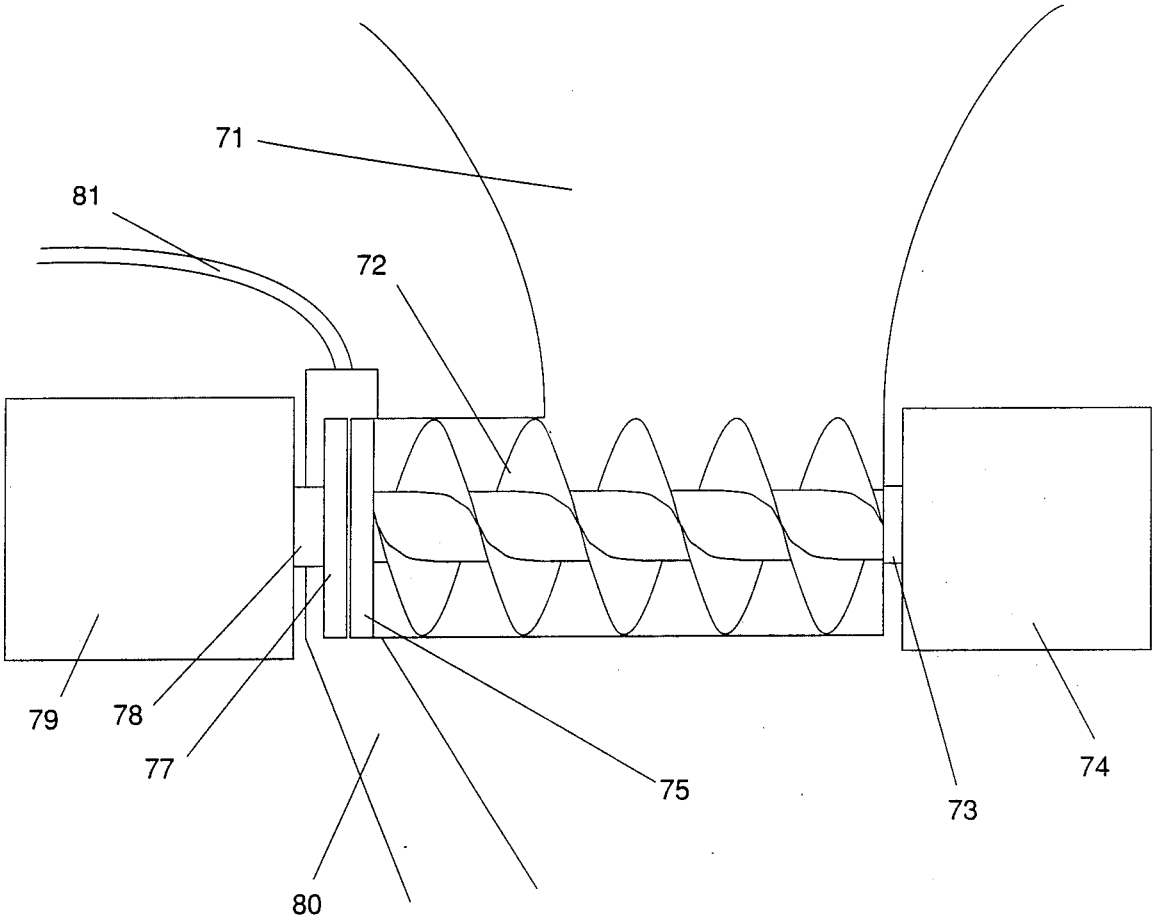
Figure 6B:
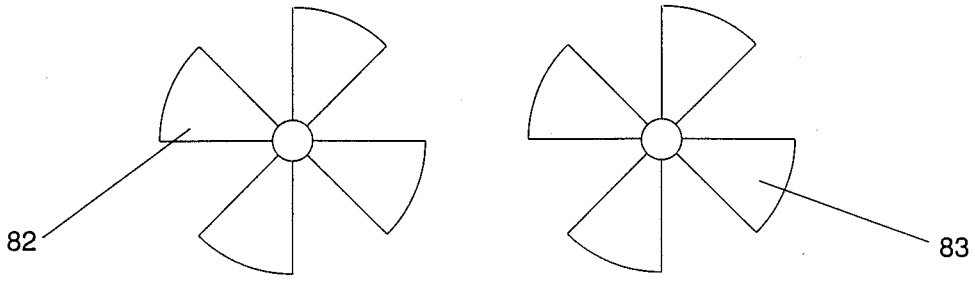

FIGS. 6A and 6B show an alternative way of cutting the medical waste.

REFERENCE NUMERALS IN DRAWINGS

10 Waste loading door
11 Safety splash door
12 Safety splash door lifting cable
13 Waste loading hopper
14 Hinge for safety splash door
15 Cutting chamber
16 Phenol fluid input to cutting chamber
17 Cutting chamber motor
18 Chute from cutting chamber to compactor
19 Compacting ram and waste entry into compacting compartment
20 Compacting compartment
21 Ram feed screw
22 Ram feed screw sprocket
23 Ram feed chain
24 Ram motor
25 Dosing pump motor
26 Phenol fluid feed hose
27 Fluid level meter
28 Phenol fluid holding tank
29 slide rails
30 Cutting blades
31 Waste scraper on blades
32 Waste in hopper switch
41 Proximity reed switch in chassis
42 Magnet in doors
43 Reed switch wires
44 Flow switch wires
45 Flow switch
46 Flow switch paddle
47 Fluid level switch
48 Fluid level switch wire
49 Fluid level paddle
50 Interlock monitor panel
51 Cutting motor current meter
52 Red light emitting diodes
53 Green light emitting diodes

54 Waste output door
55 Machine start switch
56 Waste input door
57 Compact start switch
58 phenol fluid loading door
71 Waste feed hopper
72 Auger feed
73 Auger motor shaft
74 Auger motor
75 Cutting blade on end of auger
77 Cutting blade
78 Cutting motor shaft
79 Cutting motor
80 Waste out tube
81 Phenol fluid input tube
82 Cutting blade
83 Auger cutting blade

DESCRIPTION AND OPERATION—FIG. 1 AND 2

The Portable Small Scale Medical Waste Treatment Machine will break up sharps such as syringe and suture needles and spray treat with a substance with a high phenol coefficient such as bleach or pine oil. The process is also good for all commonly used medical facility waste such as cotton balls, gauze, tongue depressors, disposable plastic syringes, and plastic gloves. The machine will also break up extracted teeth for dental office use. After the waste is treated, the refuse is compacted for convenient disposal. This machine will treat the above potentially infectious waste with a phenol solution and render it safe for common disposal practices. The machine is specifically designed for the physician with small scale infectious waste treatment needs, however hospitals could also use the machines as treatment sub-stations.

Figure 1:
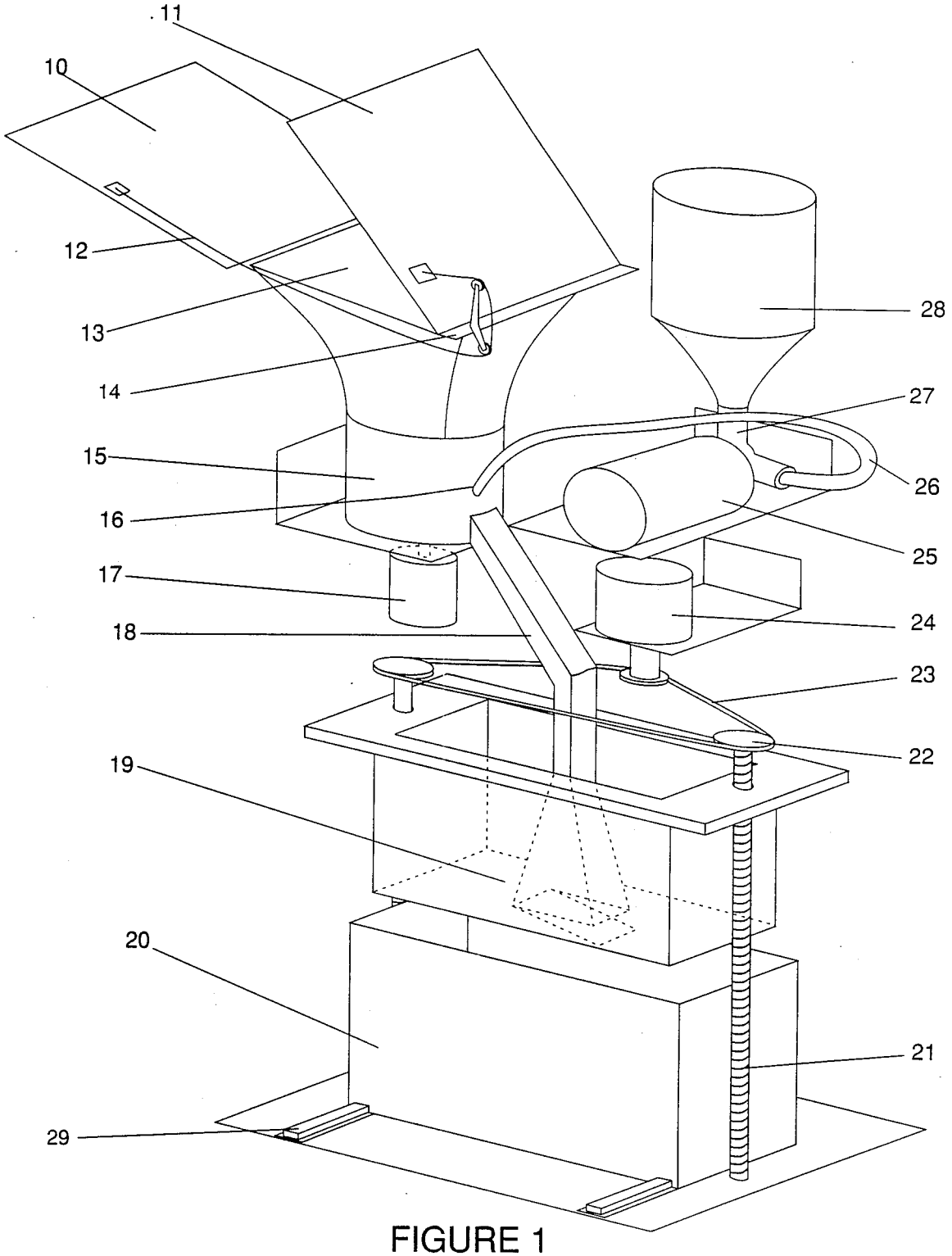
FIG. 1 shows the various internal workings of medical waste treatment machine.
Figure 2:
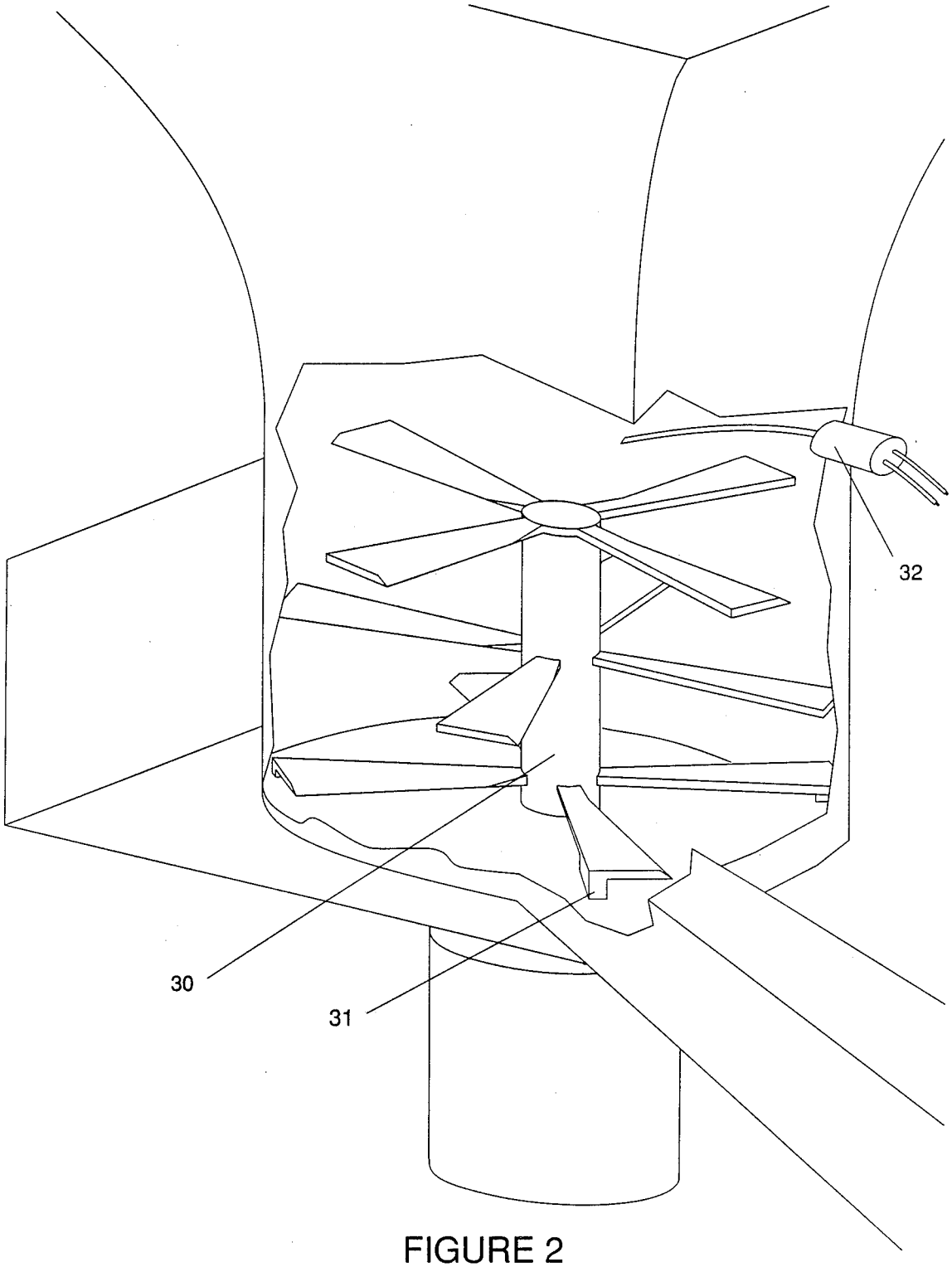
FIG. 2 shows an internal view of the cutting chamber.

FIG. 1 shows the internal embodiment of the invention Portable Small Scale Medical Waste Treatment Machine. As the waste in door 10 is pulled open, cable 12 pulls to lift splash door 11. Door 11 pivots from hinge 14. Waste is inserted into hopper 13. As door 10 closes, cable 12 is relaxed and door 11 closes. This insures no splashing of waste from the cutting chamber 15. The machine will not cycle without the waste input door closed.

Hopper 13 has the normally open switch 32 which when filled with waste closes to tell the machine that waste is in the input hopper. The machine will cycle until switch 32 is open plus a 30 second delay is actuated to insure cutting chamber 15 is emptied of waste.

The cutting chamber contains three rows of stainless steel cutting blades 30 with carbide inserts. The blades are driven by a ten amp motor 17 spinning at 3500 revolutions per minute. The bottom row of blades also have scrapers 31 to force waste down tube 18.

The phenol infectious waste treatment fluid enters the cutting chamber 15 through a stainless steel tube 26. The solution is sprayed at location 16 to insure no waste travels down tube 18 untreated. The phenol substance is held in container 28 with a level meter located at the base 27. The machine will not operate unless there is a safe phenol fluid level to sustain a cycle of waste treatment. A flow meter is located at two places along the flow tube 26 to insure phenol fluid flow monitoring during waste treatment. The machine will not cycle without fluid flow. The phenol fluid is pumped into the cutting chamber with a chemical dosing pump 25. The phenol fluid pumps into the cutting chamber as the blades are spinning to insure good mixing of the phenol fluid with the medical waste.

The chopped medical waste and phenol mixture is forced down tube 18 which is lined with Teflon to insure unrestricted flow of waste into the compacting area 20. The machine will not compact while the cutting blades are operating. The compacting process must be initiated independently of the treatment process.

Drive motor 24 spins sprocket 22 with drive chain 23, turning the threaded shaft 21. This forces the compacting ram unit 19 to drop into the compacting area 20. Compacting area 20 is mounted on slide rails 29 for ease of waste unloading. As drive motor 24 forces ram 19 into compacting area 20, the current in motor 24 rises. When the current reaches 10 amps, a switch located on ram drive motor 24 is closed forcing a reversal of the ram drive motor 24. This reverses threaded shaft 21 which in turn retracts the ram unit 19. Also shown at 19 with hidden lines is where the waste enters the compacting container. As compacting ram 19 is retracted, a hinged door on the bottom of the compacting ram opens to allow treated waste to enter the compacting area. When the compacting ram drops the hinged door closes to allow for even compacting. The cutting blades will not spin and no phenol fluid will flow during the compacting process. The treatment machine is now ready to accept more medical waste.

DESCRIPTIONS AND OPERATION—FIG. 3

Figure 3:
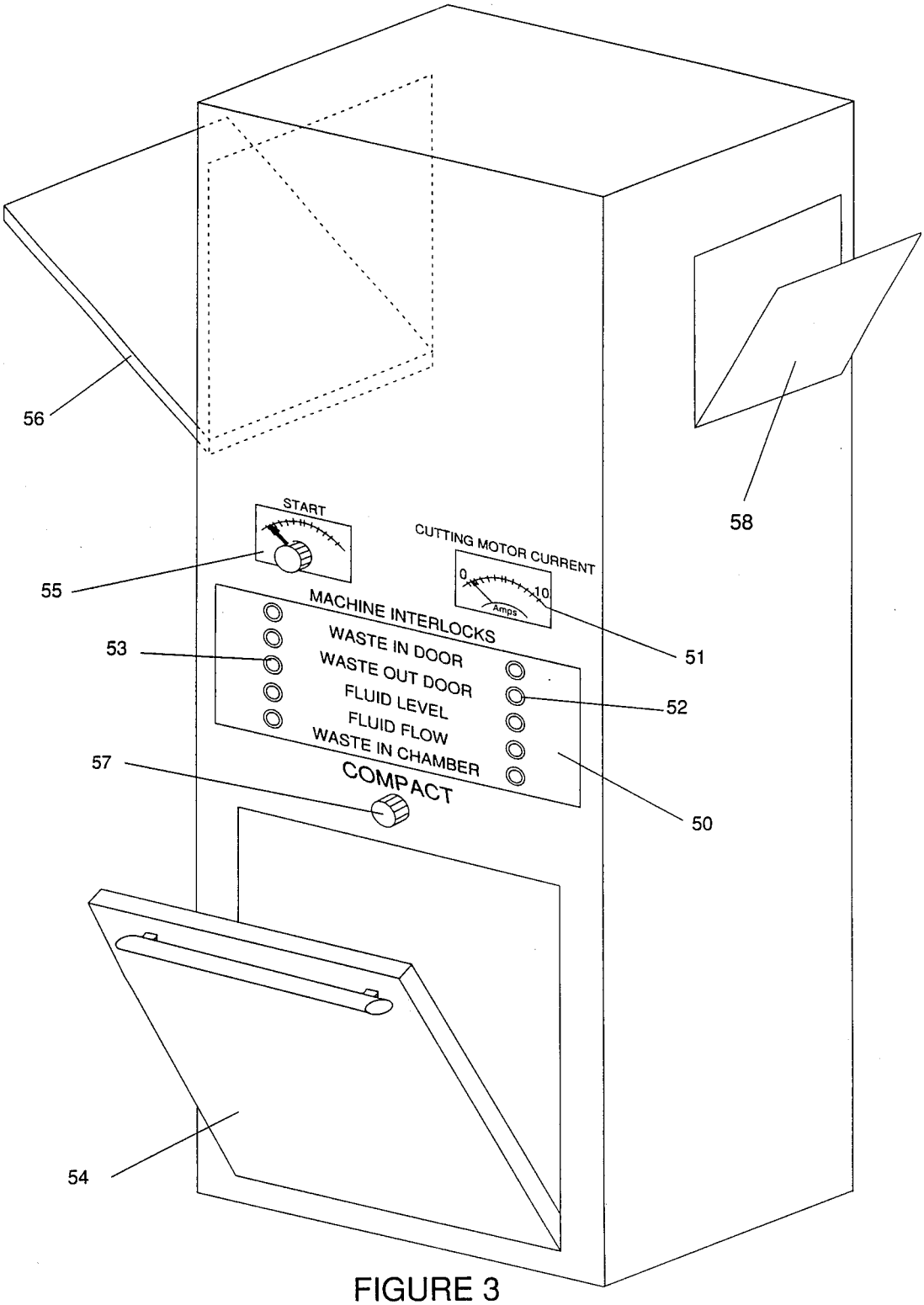
FIG. 3 shows the external medical waste machine chassis.

FIG. 3 shows the external chassis of the portable small scale medical waste treatment machine. The entire exterior chassis will be made of 316 stainless steel or similar grade stainless steel for corrosion resistance and ease of cleaning. Waste in door 56 will open past horizontal to near vertical for easy and safe waste loading. Waste out door 54 will open to horizontal to allow the disposable waste container to be removed effortlessly. The phenol fluid is loaded into door 58.

Start button 55 is a simple push button start switch. Operation will occur only if waste in cutting chamber is above a minimum level to actuate the input switch located in the waste in hopper. A manual timed cycle operation for very small loads is available. Cutting motor current is monitored with gauge 51. The machine interlocking sensors are monitored on panel 50 with red light emitting diodes 52 showing a no go condition and green light emitting diodes 53 showing a go or operational condition.

The compacting process is initiated with push button switch 57.

DESCRIPTIONS AND OPERATION—FIGS. 4A–4C AND 5

All treatment processes are interlocked to insure no passing of infectious waste through the machine without treatment. FIG. 5 illustrates the interlocks in the form of a flow chart and shows that all doors must be closed and phenol fluid must be at a minimum level and flowing for the cutting blades to operate. This also shows the Light Emitting Diodes 60 and 61 associated with each interlock sensor. Green light emitting diodes 60 are used for the GO (operational) condition and red light emitting diodes 61 are used for the NO GO (interlock open) condition. All LED's are located on the front panel of the machine for easy monitoring and alarmed interlocks are optional.

FIG. 4A–C shows sensors used for interlocks and monitoring. The phenol fluid level sensor insures a minimum level with a single station fluid level sensor. A multi-level sensor is also available for constant level monitoring.

Reed switch 41 is located in the chassis at the waste in and waste out door locations. Magnets 42 are located in the waste in and waste out doors. When the doors are closed the magnetic pull forces the reed closed and the machine will operate. When the doors are open the magnetic pull is not strong enough to hold the reed switch closed opening up the circuit and not allowing a machine start-up. Wires 43 are connected to the reed switch and integrate into a relay circuit located behind the interlock panel.

Flow switch 45 is located in two places along the phenol fluid feed tube. When paddle 46 is in the vertical position, the switch inside is open causing an open circuit and the machine will not operate. As the fluid flows, the paddle 46 begins to move off vertical closing the switch and allowing the machine to operate. Wires 44 lead to a relay circuit located behind the interlock monitor panel. The cutting motor relay has a two second delay built in because the flow paddles do not close until fluid is flowing. The cutting motor would never start without this delay because the flow paddles must have a chance to go off vertical to allow for a motor start-up.

The fluid level switch 47 is located at the base of the phenol fluid holding tank. When paddle 49 is in the horizontal position, the phenol fluid level is sufficient to float the paddle and an internal switch is closed. The machine is now operational. When the phenol fluid level sags, paddle 49 drops, the circuit opens and the machine will not operate. Switch wires 48 lead to a relay circuit on the back of the interlock panel.

The compacting process is separate from the treatment process and no treatment is possible while the machine is compacting.

DESCRIPTION AND OPERATION—FIGS. 6A AND 6B

FIG. 6A shows an alternative method of waste chopping. Medical waste enters hopper 71 and comes in contact with auger 72. Auger 72 is driven by auger motor 74 and auger motor shaft 73. Auger motor 74 is geared low for maximum torque so no clogging or motor stopping will occur during feeding. The auger motor will turn at 60 revolutions per minute. As the medical waste is fed via the auger, the waste is forced through a screen and then rough cut with blade 75 (FIG. 6B—83). After the rough cut, blade 77 spinning at 1725 revolutions per minute chops all medical waste into small pieces dulling all sharps. Blade 77 is driven by motor 79 and shaft 78. Blade 77 is shown in FIG. 6B—82. Both the fast and slow blades have carbide inserts to insure that metal sharps will not dull blades. The carbide inserts can be replaced by a technician. All chopped waste then travels down tube 80 to the compactor.

SUMMARY, RAMIFICATIONS, AND SCOPE

Accordingly, the reader will see that the portable small scale medical waste treatment machine will eliminate sharps and treat waste in a safe and effective manner, eliminating the need for special trash handling.

The machine will use conventional trash compacting containers used with standard household trash compactors.

The machine's interlocking sensors will not allow the passing of waste through the machine without being treated.

The machine used a biodegradable high phenol coefficient fluid to kill infectious waste.

The machine provides a treatment process for the small scale waste generator and a close proximity fast treatment process to instantly eliminate sharps and infectious waste.

Although the description above contains many specifications, these should not be construed as limiting the scope of the invention but merely providing illustrations of some of the presently preferred embodiments of the invention. For example, there are two cutting chamber designs shown. Also there are other infectious waste treatment processes being considered such as ultraviolet light, ultrasound and infrared light.

Thus the scope of the invention should be determined by the appended claims and their legal equivalents, rather than by the examples given.

I claim:

1. A machine for the disposal and treatment of infectious medical waste comprising:

(a) cutting chamber;

(b) said cutting chamber comprising rotating cutting blades of sufficient spinning velocity to cut metal and fibrous materials;

(c) said cutting chamber being fed a fluid with a high phenol coefficient for sufficient quantity to render bacteria and viral infectious waste safe for common waste disposal practices;

(d) said phenol fluid fed via a chemical dosing pump;

(e) said cutting blades in said cutting chamber interlocked with a proximity sensor on a waste input door to insure machine operator safe from splashing or premature spinning of said cutting blades;

(f) said cutting blades in said cutting chamber interlocked with a proximity sensor on a waste output door to insure operator will not come in contact with said infectious medical waste;

(g) cutting blades interlocked with fluid flow sensors located in a phenol fluid flow tube to insure said infectious waste is treated for safe handling;

(h) said cutting blades interlocked with fluid level sensors located at a base of a phenol fluid holding tank to insure said infectious waste is treated for safe handling.

* * * * *